US006981662B2

(12) United States Patent
Luedicke

(10) Patent No.: US 6,981,662 B2
(45) Date of Patent: Jan. 3, 2006

(54) COUPLING DEVICE ASSEMBLY

(75) Inventor: Martin Luedicke, Columbia, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 263 days.

(21) Appl. No.: 10/290,286

(22) Filed: Nov. 8, 2002

(65) Prior Publication Data

US 2004/0124252 A1 Jul. 1, 2004

(51) Int. Cl.
*B05B 1/30* (2006.01)

(52) U.S. Cl. ..... 239/585.1; 123/456; 123/470; 439/502

(58) Field of Classification Search ..... 239/585.1, 239/585.2; 123/456, 468, 472, 470, 490, 123/499, 143 C; 439/606, 502, 843
See application file for complete search history.

(56) References Cited

U.S. PATENT DOCUMENTS 4,225,206 A * 9/1980 Roman, Jr. ..... 439/274
4,922,880 A 5/1990 Seibt et al.
5,086,743 A 2/1992 Hickey
5,127,382 A 7/1992 Imoehl
5,178,362 A 1/1993 Vogt et al.
5,203,304 A 4/1993 Hafner et al.
5,295,860 A * 3/1994 Jozefczyk et al. ..... 439/503
5,330,153 A 7/1994 Reiter
5,513,613 A 5/1996 Taylor et al.
5,577,480 A * 11/1996 Gmelin et al. ..... 123/470
6,834,844 B1 * 12/2004 Hamada et al. ..... 251/129.1

* cited by examiner

*Primary Examiner*—Dinh Q. Nguyen
(74) *Attorney, Agent, or Firm*—McGuireWoods LLP

(57) ABSTRACT

A coupling device having a body portion is adapted to be mated with an end cap assembly of a fuel injector. The body portion has a connecting portion spanning between a first electrical connector and a second electrical connector at opposing ends thereof. A first set of conductive leads connects the first electrical connector to a first set of solenoid wires and a second set of conductive leads connects the second electrical connector to a second set of solenoid wires. The first set of conductive leads spans the connecting portion to connect the first electrical connector and the first set of solenoid wires. An end cap and coupling device as well as a fuel injector assembly using the coupling device is provided.

26 Claims, 9 Drawing Sheets

COUPLING DEVICE ASSEMBLY

BACKGROUND OF THE INVENTION

1. Field of the Invention

The present invention relates to a coupling device for use with a fuel injector and, more particularly, to a coupling device (connector bridge) used to connect solenoid wires to an end cap assembly while maintaining the solenoid wires away from a control valve of the fuel injector.

2. Background Description

Many internal combustion engines are designed to use fuel injectors. In such a typical internal combustion engine, the fuel injector is mounted partly within the combustion chamber of the engine, with the control valve mechanism mounted beneath the valve covers of the engine. In this type of configuration, the control valve mechanism which, in some conventional injectors, include solenoids and end caps, are connected to an engine wire harness assembly via solenoid wires. The engine wire harness, in turn, is connected to a driver which provides or delivers a current to the solenoids for providing control to the fuel injector, itself.

In general, the driver delivers a current or voltage to an open side of an open coil solenoid via the solenoid wires. The magnetic force generated in the open coil solenoid will shift a spool into the open position so as to align grooves or orifices (hereinafter referred to as "grooves") of the control valve body and the spool. The alignment of the grooves permits the working fluid (i.e., hydraulic fluid) to flow into an intensifier chamber from an inlet portion of the control valve body. The high-pressure fluid then acts on an intensifier piston which, in turn, compresses fuel located within a high-pressure plunger chamber. As the pressure in the high-pressure plunger chamber increases, the fuel pressure rises above a needle check valve opening pressure. At the prescribed fuel pressure level, the needle check valve will shift against a needle spring and open the injection holes in a nozzle tip for injection.

At the end of the cycle, the driver will deliver a current or voltage to the closed coil solenoid. The magnetic force generated in the closed coil solenoid will shift the spool into the closed position so as to align grooves of the spool with ejection or discharge ports of the control valve body. This alignment permits the working fluid to flow from the intensifier chamber, through the discharge ports and then be ejected from the control valve body, via the discharge ports. The discharge of the working fluid is at a high pressure. Once the working fluid is discharged, it is captured and reused by the injector. Of course, fuel injectors may vary in their functionality such as fuel injectors with needle back pressure systems and the like; however, the above description is generally descriptive of the basic functioning of the fuel injector.

In these types of systems, however, the solenoid wires are permanently connected to the end caps and are routed over the discharge ports and adjacent the rocker arm assemblies of the engine. The wire harness assemblies for the solenoid wires are also located adjacent the rocker arm assemblies in such a manner that the solenoid wires must bridge the gap between the open and closed coil solenoid and the wire harness assembly (which is approximately 150 mm). In such a harsh environment, the solenoid wires are subject to failure, from such causes as:

1. vibrations caused by the rocker arm assemblies,
2. chaffing or striking from the rocker arm assemblies, or
3. vibrations caused when the working fluid is discharged from the fuel injectors.

These factors, over time, lead to a failure of the fuel injector. This, of course, adversely affects the efficiency of the engine and, in instances, may result in a catastrophic failure of the engine. To repair the engine, or more particularly the solenoid wires, the entire fuel injector must be replaced including the solenoid wires. This is due to the permanent connection between the solenoid wires and the end caps. Alternatively, the entire fuel injector must be removed from the engine and the solenoid wires replaced. This is a time consuming and costly process. It is also noted that the fuel injector and solenoid wire assembly (due to the one-piece assembly) may be difficult to maneuver into place, again leading to higher manufacturing and repair costs.

The present invention is directed to overcoming one or more of the problems as set forth above.

SUMMARY OF THE INVENTION

In a first aspect of the present invention, a coupling device includes a body portion adapted to be mated with an end cap assembly of a fuel injector. The body portion has a connecting portion spanning between a first electrical connector and a second electrical connector at opposing ends of the body portion. A first set of conductive leads connects the first electrical connector to a first set of solenoid wires and a second set of conductive leads connects the second electrical connector to a second set of solenoid wires. The first set of conductive leads spans the connecting portion to connect the first electrical connector and the first set of solenoid wires. In embodiments, the first set of conductive leads and the second set of conductive leads are electrically isolated from each other and are molded into the body portion, including the connecting portion.

In another aspect of the present invention, the coupling has a main body portion having a first and second shoulder, an end body adjacent to the second shoulder, first and second housings extending from the first and second shoulders and a connecting portion. The connecting portion connects the first shoulder and the second shoulder. A first and second set of solenoid wires partially extend within the end body portion and a first set of terminals are associated with the first housing and a second set of terminals are associated with the second housing. A first set of conductive leads electrically connect the first set of terminals to the first set of solenoid wires and spans the connecting portion. Also, a second set of conductive leads electrically connects the second set of terminals to the second set of solenoid wires. In embodiments, the conductive leads are molded in the main body portion and more specifically in the connecting portion.

In yet another aspect of the present invention, a device for coupling a wire harness to a fuel injector is provided. This device includes a coupling device having a body portion having a connecting portion connecting a first housing and a second housing at opposing ends thereof. The housings each house first and second terminal portions, respectively. A first set of conductive leads spans the connecting portion to connect the first terminal portion to a first set of solenoid wires and a second set of conductive leads connects the second terminal portion to a second set of solenoid wires. An end cap assembly is coupled to the coupling device and includes a first housing at a first side for housing a first end cap terminal and a second housing at a second side for housing a second end cap terminal. The first terminal portion and the first end cap terminal are electrically couplable to one another, and the second terminal portion and the second end cap terminal are electrically couplable to one another.

In embodiments of this and other aspects, the body portion may include a first shoulder and a second shoulder and an end body portion adjacent to the second shoulder. The first housing extends from the first shoulder and the second housing extends from the second shoulder. The connecting portion connects the first shoulder and the second shoulder. The first and second housings of the end cap include a first and second cavity that couples with the first and second housing of the coupling device, respectively. A locking device may be provided for locking the first housing and the second housing of the coupling device to the first housing and the second housing of the end cap, respectively. Additionally, the first and second set of conductive leads and the first and second set of solenoid wires may be molded into the coupling device. In further embodiments, the terminal portions of either the coupling device or the end caps may be (i) female-type electrical connectors, (ii) male-type electrical connectors, (iii) opposing spring-like electrical connectors and (iv) contact plates. The connecting portion fits about the end cap assembly.

In yet another embodiment of the present invention, a fuel injector assembly is provided. The fuel injector assembly includes a fuel injector having a control valve body, an intensifier housing coupled to the control valve body and a nozzle assembly coupled to the intensifier housing. The assembly further includes a coupling device having a body portion having a connecting portion spanning between a first housing and a second housing, each of which house first and second terminal portions, respectively. The coupling device further includes a first set of conductive leads spanning the connecting portion to connect the first terminal portion to a first set of solenoid wires. A second set of conductive leads connects the second terminal portion to a second set of electrical connector leads. An end cap of the assembly is coupled to the coupling device and the control valve. The end cap assembly includes a first housing extending from a first side and housing a first end cap terminal portion and a second housing extending from a second side and housing a second end cap terminal portion. The first terminal portion and the first end cap terminal portion are electrically couplable to one another, and the second terminal portion and the second end cap terminal portion are electrically couplable to one another. In embodiments, the connecting portion fits about the control valve.

In yet still another embodiment of the present invention, a method is provided for manufacturing a coupling device. The method includes the steps of:

1. providing conductive leads with connector portions extending therebetween;
2. attaching (e.g., soldering) respective ends of the conductive leads to solenoid wires and first and second terminal portions to form an assembly;
3. placing the assembly in a mold having pins, the pins corresponding to locations of the connector portions;
4. overmolding the assembly within the mold to form a molded assembly;
5. removing the molded assembly from the mold; and
6. punching holes corresponding to the placement of the pins and the connector portions in order to electrically isolate each of the conductive leads.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to a coupling device used with a fuel injector. The coupling device (referred to also as a connector bridge) is adapted to be coupled and decoupled to an end cap of a control valve of the fuel injector. The coupling device of the present invention is also designed to maintain the solenoid wires away from the rocker arm assemblies and fluid discharge ports of the fuel injector, itself. These features ensure that the rocker arm assemblies as well as the fluid being ejected from the fuel injector will not fray, fatigue or otherwise cause a failure of the solenoid wires. The coupling device also ensures that the solenoid wires remain substantially stationary thereby preventing any fatigue or failure of the solenoid wires caused by vibrational events. As a further advantage of the present invention, any failure of the solenoid wires, terminals to the end cap assembly or other parts may easily be replaced by simply removing and replacing the coupling device of the present invention. That is, by using the coupling device of the present invention there is no need to cut the solenoid wires, and remove and disassemble the fuel injector due a failure of a part.

Embodiments of the Coupling Device of the Present Invention

Figure 1:
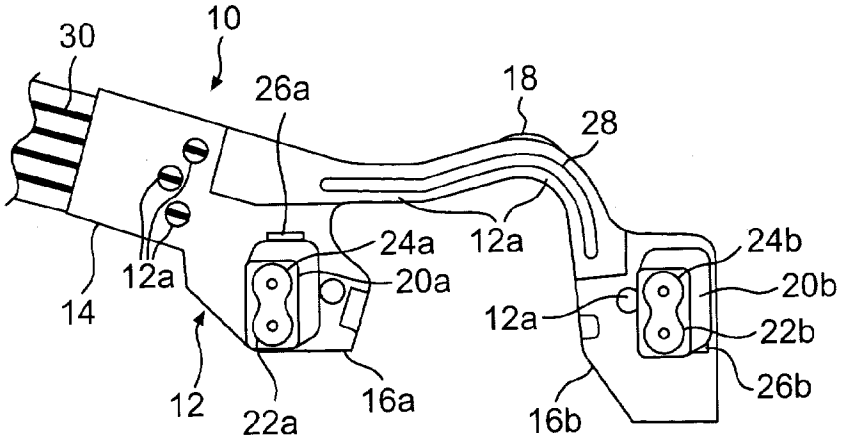
FIG. 1 shows a bottom view of the coupling device of the present invention.

Referring now to FIG. 1, a bottom view of the coupling device of the present invention is shown. The coupling device is generally depicted as reference numeral 10 and includes a body portion 12, preferably molded from any well-known materials. The body portion 12 includes an end portion 14, shoulder portions 16*a*, 16*b* and a connecting portion 18. In embodiments, the connecting portion 18 is a bridge or span connecting the shoulders 16*a* and 16*b*. In embodiments, a plurality of holes or punches 12*a* may be dispersed throughout the end portion 14, shoulder portions 16*a*, 16*b* and the connecting portion 18. It should be understood by those of skill in the art that the terminology "shoulder portion" may equally be exchanged with other terminology to describe this feature of the coupling device such as a projection, support, member, platform or the like. However, for convenience and consistency, shoulder portion will be used throughout the present description.

Still referring to FIG. 1, housings 20*a* and 20*b* are molded or mounting to the respective shoulders 16*a* and 16*b*, where each of the housings has an interior cavity 22*a* and 22*b*. In one aspect of the present invention, the first and second shoulders, the first and second housings and the connecting portion are a single integral molded piece. Terminals 24*a* and 24*b* are respectively provided within the housings 20*a* and 20*b* and, in aspects of the invention, within the respective cavities 22*a* and 22*b*. In one embodiment, the terminals 24*a* and 24*b* may be female-type connectors within the respective cavities 22*a* and 22*b*. In alternative embodiments, the terminals 24*a* and 24*b*, may be male-type connectors, opposing spring-like connectors, contact plates or any combination thereof or the like. The housings 20*a* and 20*b* preferably extend downward from the shoulder portions 16*a* and 16*b*, and may be molded into various shapes such as round, square, rectangular, oval and the like.

FIG. 1 further shows clips or other fastening devices 26*a* and 26*b* provided adjacent to each of the housings 20*a* and 20*b*. In embodiments, the fastening device 26*a* is located at one side of the housing 20*a* and the fastening device 26*b* is located at another side of the housing 20*b*. In other words, the fastening devices 26*a* and 26*b*, in embodiments, are not located on a same side of the respective housings 20*a* and 20*b*, but are provided in an offset configuration. Conductive leads 28 are molded into the body portion 12 and are electrically connectable between the terminals 22*a* and 22*b* and solenoid wires 30. In embodiments, a first set of conductive leads extends from the terminals 24*a* to the solenoid wires via the shoulder portion 16*a* to the end portion 14. Additionally, a second set of conductive leads extends from the terminals 24*b* to the solenoid wires via the shoulder portion 16*b*, the connecting portion 18 and the end portion 14. The conductive leads 28 and portions of the solenoid wires 30 are preferably molded into the body 14 of the present invention, where each of the conductive leads are electrically isolated to prevent shorting. The solenoid wires 30 are also electrically isolated from one another, but electrically connected to each of the respective conductive leads 28. The molding of the solenoid wires into the coupling device prevents rotation of the solenoid wires, as well as directs the solenoid wires away from the fuel injector and other components of the internal combustion engine to prevent failure thereof.

Figure 2:
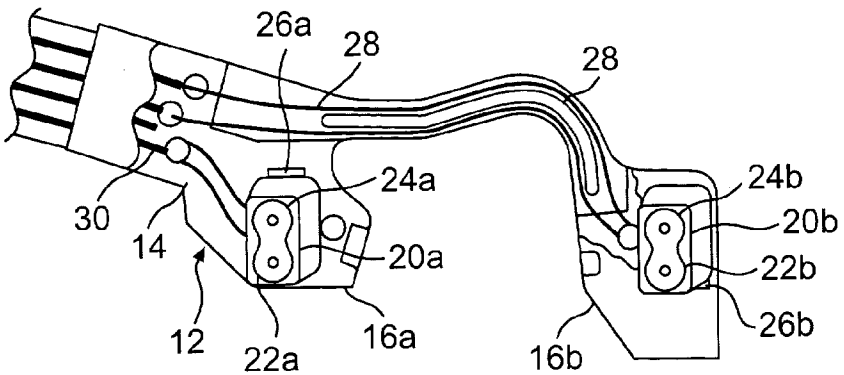
FIG. 2 shows a bottom view of the coupling device of the present invention with a cut-away portion.

FIG. 2 shows a bottom view of the coupling device of the present invention with a cut-away portion. In this view, it is shown that the conductive leads 28 and portions of the solenoid wires 30 are molded into the body 14 of the coupling device of the present invention. This view further shows the first set of conductive leads extending from the terminals 24*a* to the solenoid wires and the second set of conductive leads extending from the terminals 24*b* to the solenoid wires. In one aspect, the first set of conductive leads extends via the connecting portion 18.

Figure 3:
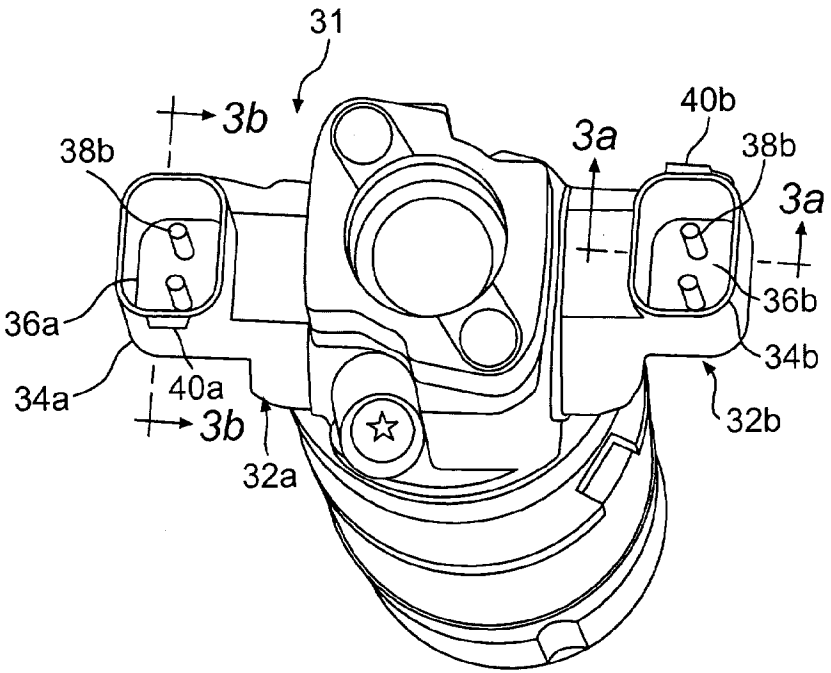
FIG. 3 shows a top view of an end cap design of the present invention used with the coupling device of FIG. 1.

FIG. 3 shows a top view of an end cap design of the present invention used with the coupling device 10 of FIG. 1. In this embodiment, the control valve of the fuel injector is generally depicted as reference numeral 31. End caps 32*a* and 32*b* are coupled to respective sides of the control valve 31 for providing control to the fuel injector in a manner well known in the art. In the embodiment of FIG. 3, the end caps 32*a* and 32*b* include respective housings 34*a* and 34*b*, each formed with a cavity 36*a* and 36*b*. Male-type terminals 38*a* and 38*b* extend within each of the respective cavities 36*a* and 36*b*. It should be well recognized that the terminals of the end caps may also be female-type connectors, opposing spring-like connectors, contact plates, a combination thereof or the like, depending on the configuration of the terminals of the coupling device 10.

Figure 6:
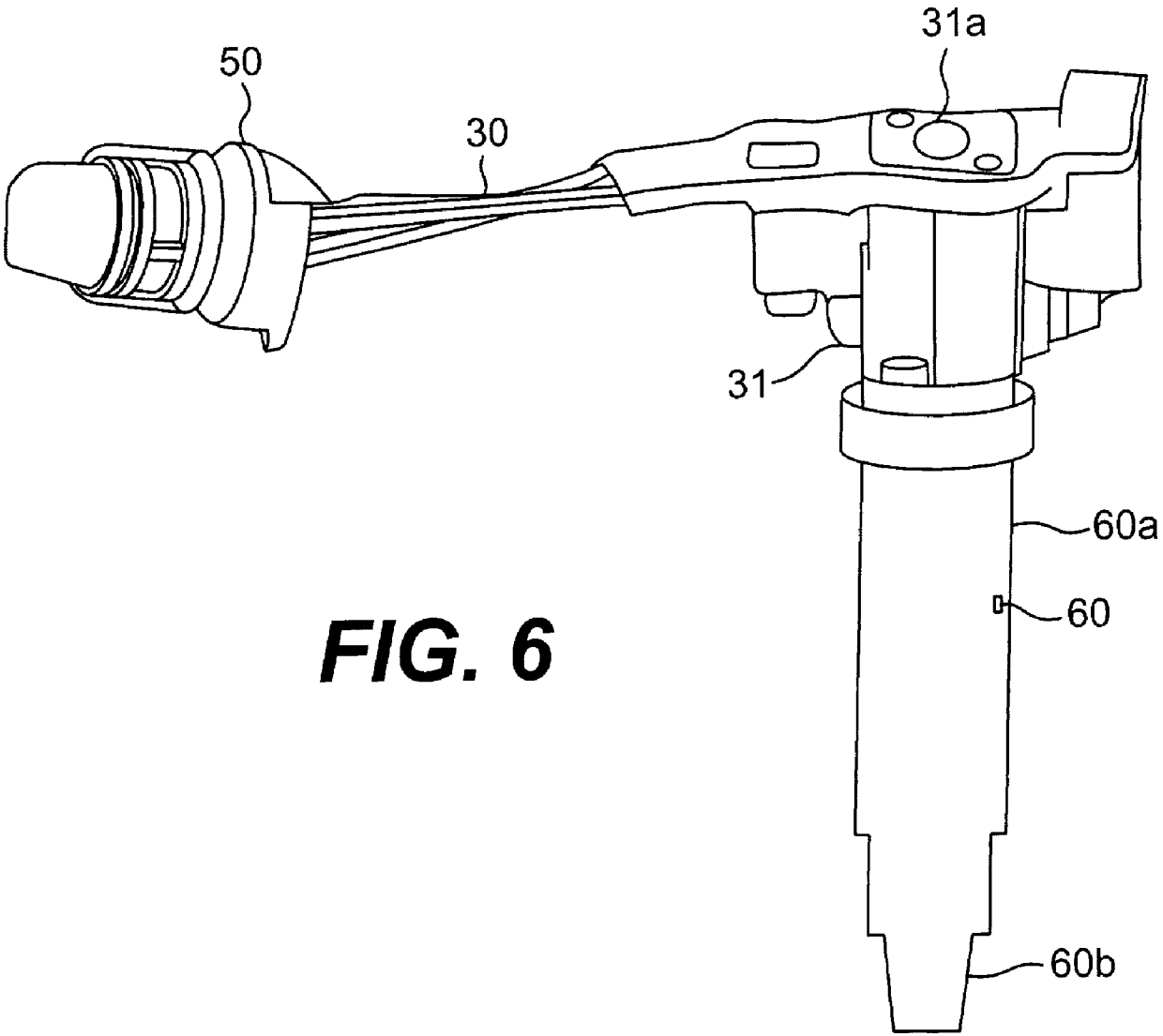
FIG. 6 shows an assembled perspective view of the coupling device and the end cap of an embodiment of the present invention.

In embodiments, in the coupled state, the housings 20*a* and 20*b* of the coupling device 10 are sized and shaped to fit within the respective cavities 36*a* and 36*b* of the end caps. In this manner, the respective terminals of the end caps and coupling device, in the coupled state, are in electrical contact. A projection 40*a* and 40*b* extends from an exterior part of the respective housing 34*a* and 34*b*, corresponding to and aligning with the clips or other fastening devices 26*a* and 26*b*. In an alternative embodiment, the housings 34*a* and 34*b* of the end caps may be sized and shaped to fit within the respective cavities 22*a* and 22*b* of the coupling device. The projections 40*a* and 40*b* extend from an exterior part of the respective housings of the coupling device, corresponding to and aligning with the clips or other fastening devices extending from the end caps. The combination of the clips and projections provide for a locking mechanism, as shown in FIG. 6.

Figure 4B:
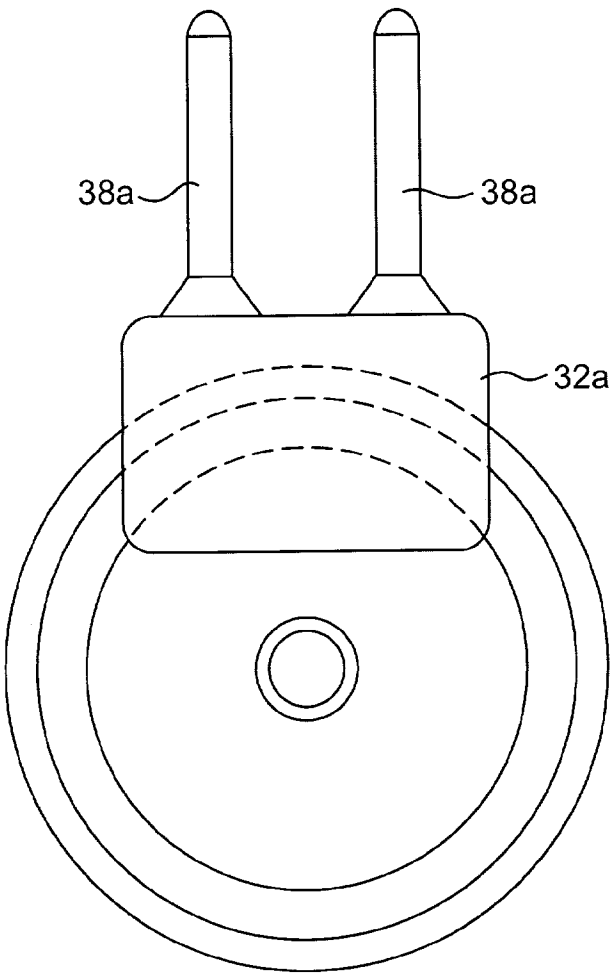
FIG. 4*b* shows a cross sectional view of the end cap design of FIG. 3 along line 3*b*—3*b;*
Figure 4A:
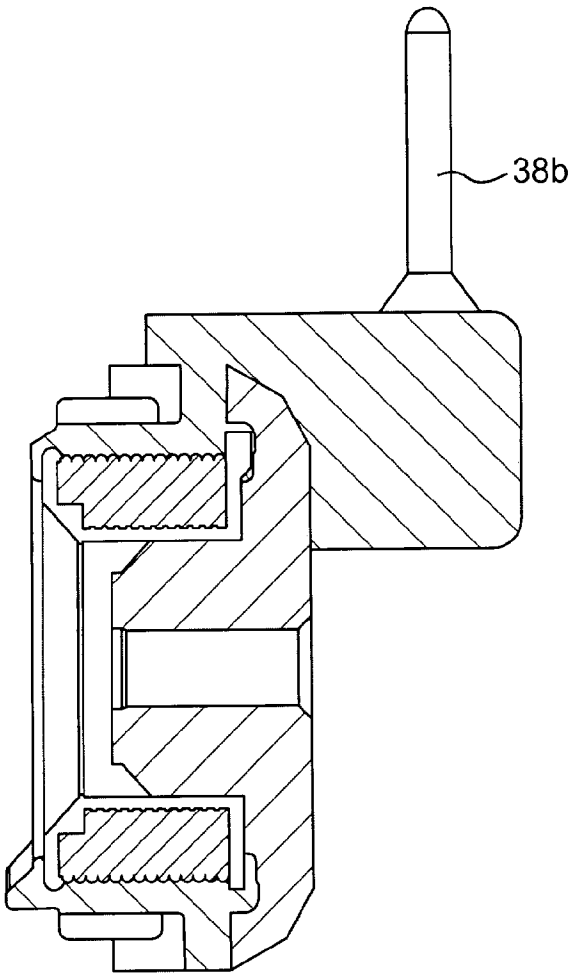
FIG. 4*a* shows a cross sectional view of the end cap design of FIG. 3 along line 3*a*—3*a;*

FIG. 4*a* shows a cross sectional view of the end cap design of FIG. 3 along line 3*a*—3*a* and FIG. 4*b* shows a cross sectional view of the end cap design of FIG. 3 along line 3*b*—3*b*. In the embodiments of FIGS. 4*a* and 4*b*, the terminals of the end caps are shown as male-type terminals 38*a* and 38*b*.

Figure 5:
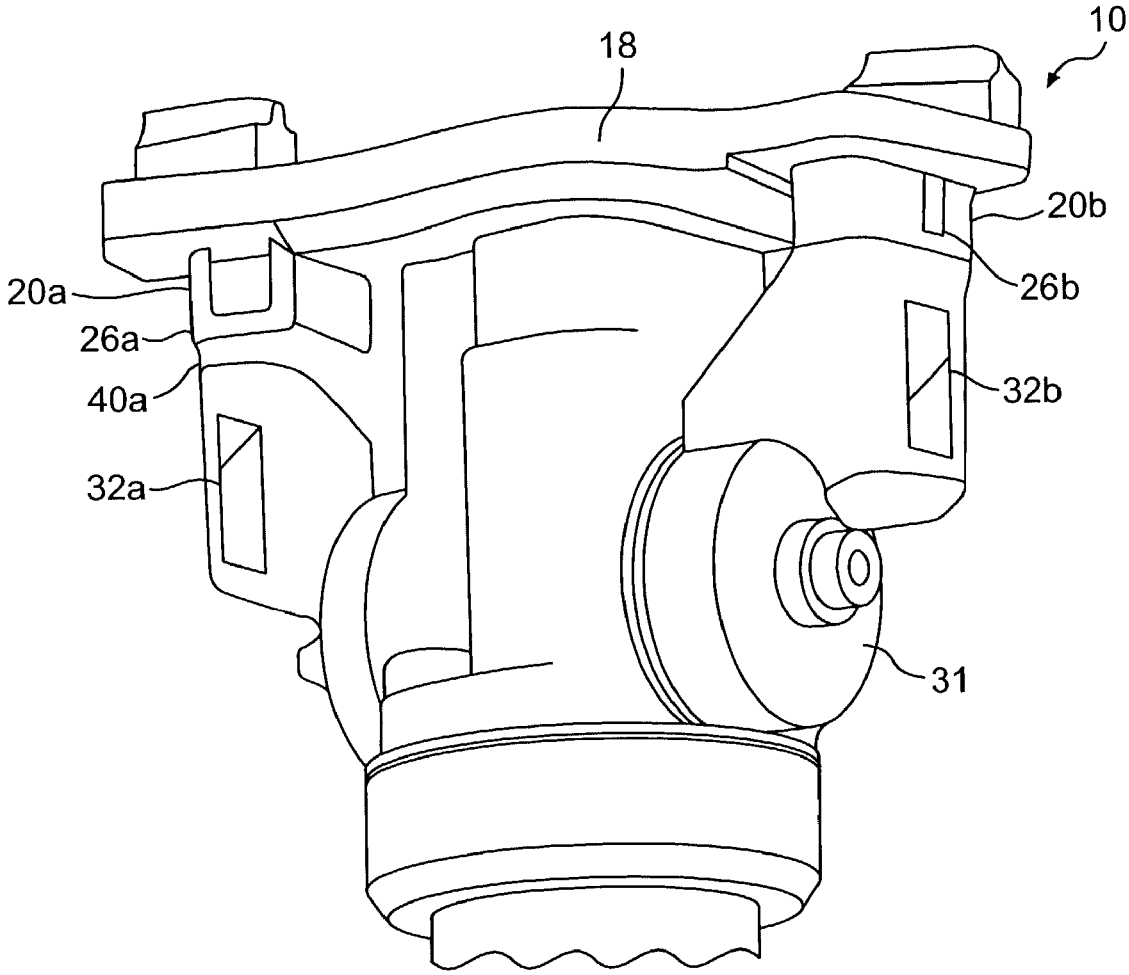
FIG. 5 shows a partially assembled perspective view of the coupling device and the end cap of FIGS. 1 and 3, respectively.

FIG. 5 shows a partially assembled perspective view of the coupling device and the end cap of any embodiment of the present invention. In this embodiment, the housings 20*a* and 20*b* are fitted within the respective cavities 36*a* and 36*b* of the end caps. The projections 40*a* and 40*b* are aligned with the clips 26*a* and 26*b* in order to securely mount the coupling device to the end caps of the present invention. In embodiments, the fastening device 26*a* is located at one side of the housing 20*a* and aligned with the projection 40*a* placed on a same side of the housing 34*a*. Likewise, the fastening device 26*b* is located at another side of the housing 20*b* and aligned with the same side of the housing 34*b*. In other words, the fastening devices 26*a* and 26*b* and projections 40*a* and 40*b* are, in embodiments, in an offset configuration. It is further seen that the connecting portion 18 extends around the control valve 31 thus ensuring the elimination of:

1. vibrations of the solenoid wires caused by the rocker arm assemblies,
2. chaffing or striking of the solenoid wires from the rocker arm assemblies, or
3. vibrations of the solenoid wires caused when working fluid is discharged from the fuel injector.

It should be understood that the coupling device 10 of the present invention is designed, basically, to the shape of the control valve 31 and more particularly to align with the placement of the end caps. Accordingly, the coupling device 10 of the present invention, and more particularly the connecting portion 18 and the housings may have other configurations or sizes depending on the size and shape of the fuel injector. Thus, the coupling device is not limited to the shape and size shown in FIGS. 1–5.

FIG. 6 shows an assembled perspective view of the coupling device and the end cap of an embodiment of the present invention. In this view, the solenoid wires 30 are shown connected to a wire harness 50. The end caps are connected to the control valve 31 which, in turn, is coupled to a fuel injector 60 having an intensifier body 60*a* and a nozzle 60*b*. The fastening devices 26*a* and 26*b* are fully coupled to the projections 40*a* and 40*b* in order to securely mount the coupling device 10 to the respective end caps of the control valve 31. This prevents decoupling and elimination of vibration problems. The solenoid wires 30 are remote from the discharge port 31*a* of the fuel injector.

Figure 7B:
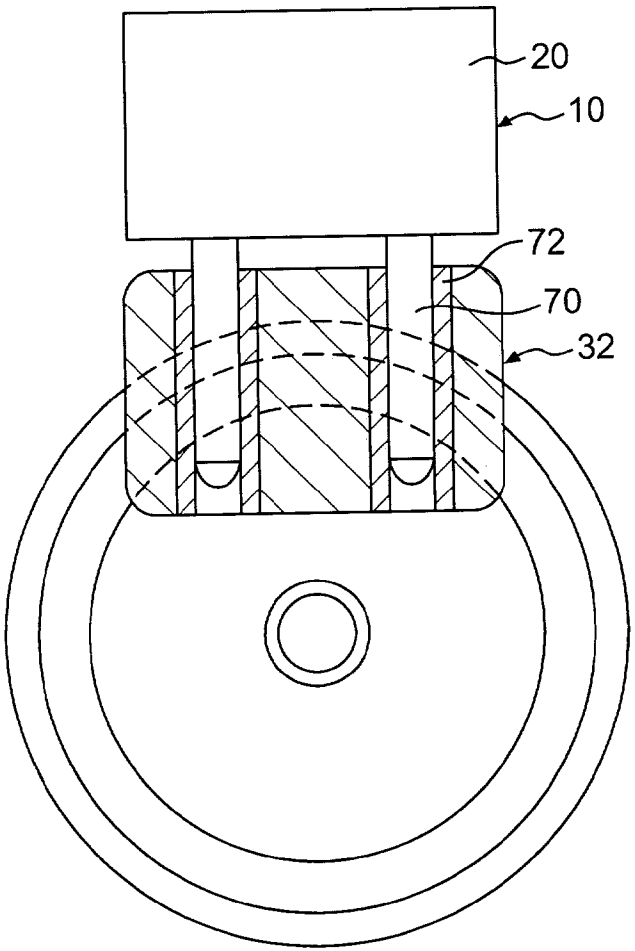
FIGS. 7*a* and 7*b* show another embodiment the coupling device and the end cap of an embodiment of the present invention.
Figure 7A:
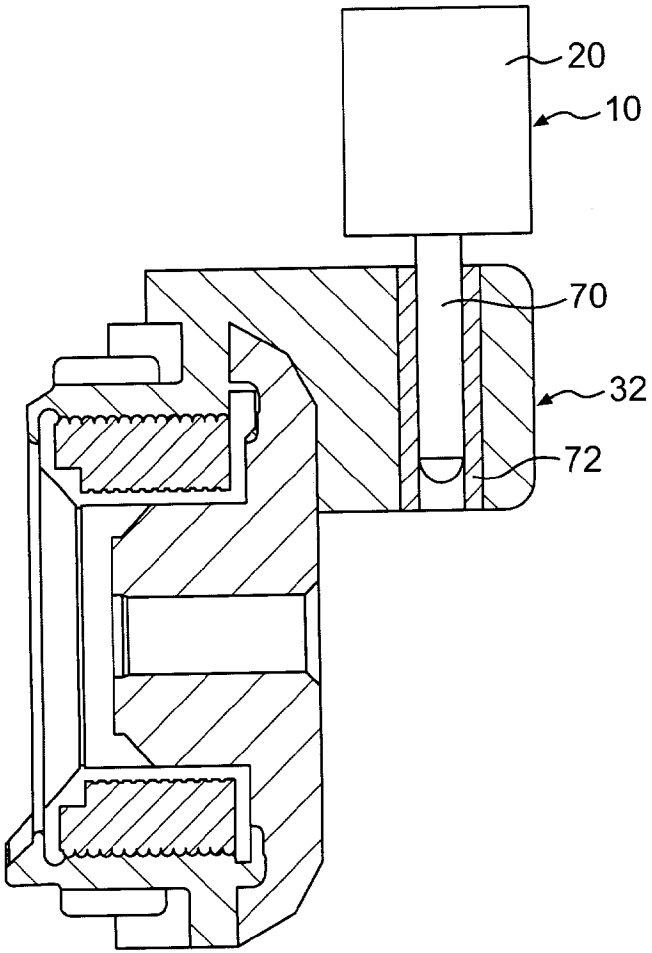

FIGS. 7*a* and 7*b* show another embodiment of the coupling device and the end cap of the present invention. In the embodiments of 7*a* through 9*b*, each of the end cap housings is generally depicted as reference numeral 34 and each of the coupling device housings is generally depicted as reference numeral 20. In FIGS. 7*a*–7*b*, the end cap housing 34 has female-type connector terminals 72 and the coupling device housing 20 has male-type connector terminals 70. In the coupled state, the male-type connector terminals 70 are designed to couple to the respective female-type connector terminals 72. FIGS. 1–3 depict the remaining features of the coupling device and the end caps.

Figure 8B:
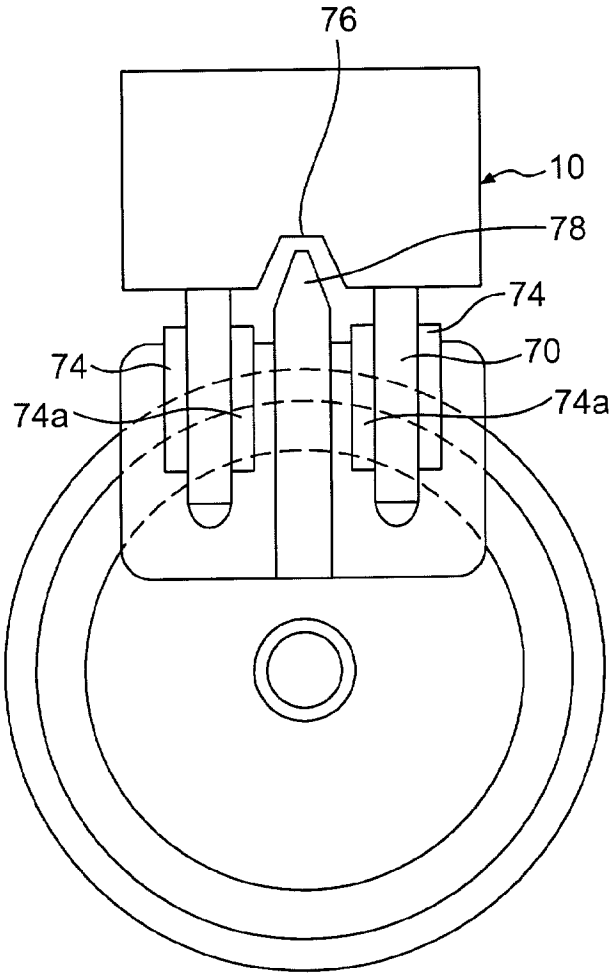
FIGS. 8*a* and 8*b* show an embodiment the coupling device and the end cap of the present invention.
Figure 8A:
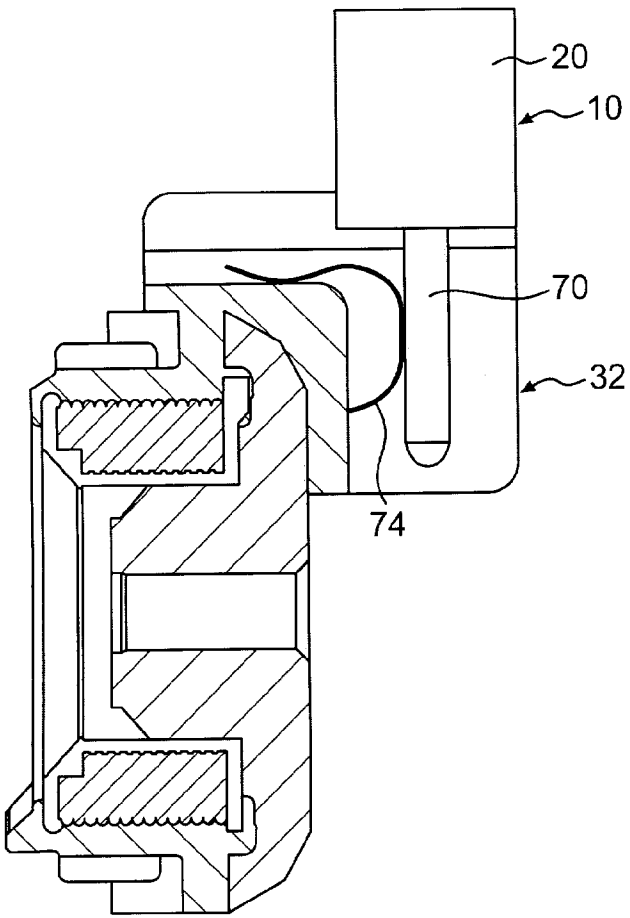

FIGS. 8*a* and 8*b* show another embodiment the coupling device and the end cap of the present invention. In this embodiment, the coupling device housing 20 has male-type connector terminals 70 and the end cap housing 34 has two sets of opposing spring-like connectors 74. In the coupled state, the male-type connector terminals 70 are sandwiched between and are in electrical communication with each respective set of opposing spring-like connectors 74. A groove 76 is provided in each housing 20, between each connector terminal 70. Additionally, a projection or separator portion 78 is provided in each housing 34 of the end caps 32, between inner ones 74*a* of the opposing spring-like connectors 74. This features helps in the alignment of the housings of the end caps and the coupling device (i.e., terminals thereof) and further prevents electrical shorting or communication between the non-respective terminals. FIGS. 1–3 depict the remaining features of the coupling device and the end caps.

Figure 9B:
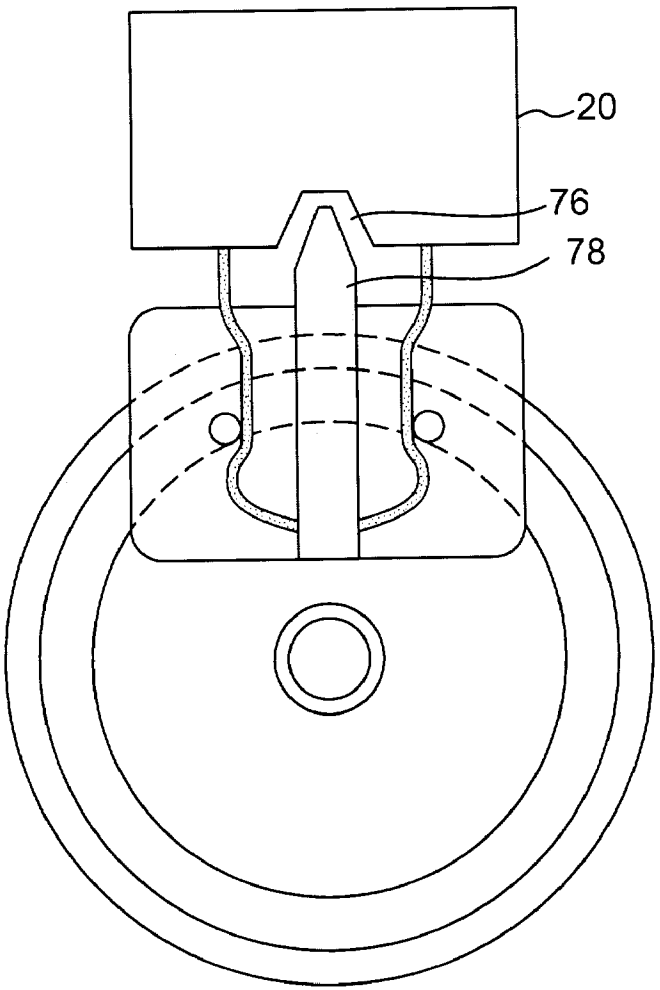
FIGS. 9*a* and 9*b* show an embodiment the coupling device and the end cap of the present invention.
Figure 9A:
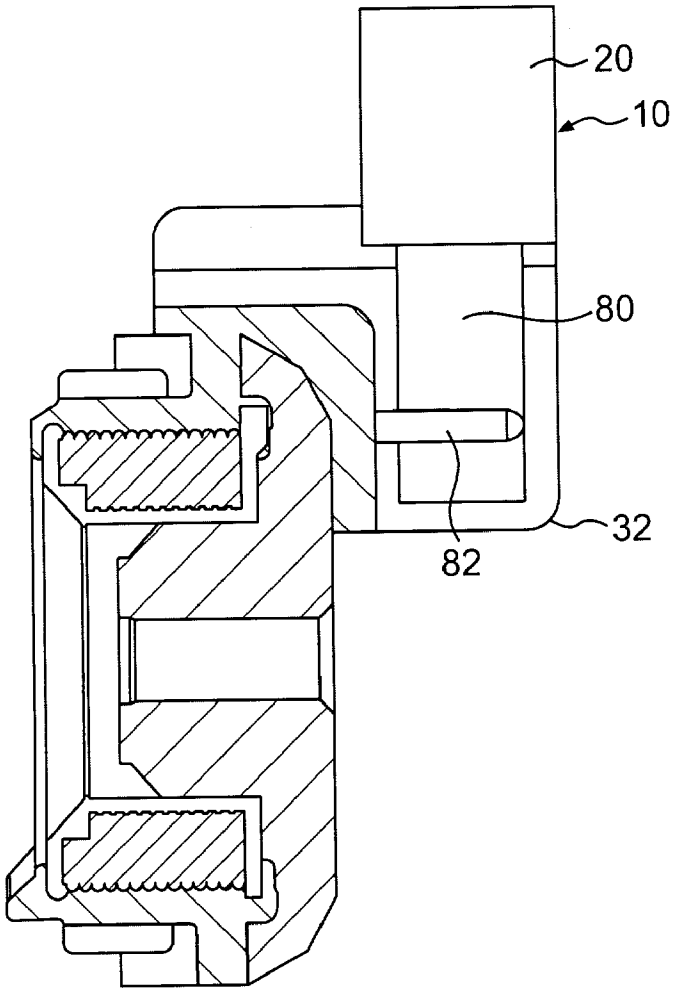

FIGS. 9*a* and 9*b* show another embodiment the coupling device and the end cap of the present invention. In this embodiment, the housing 20 includes opposing spring-like connectors 80 and the end cap housing 34 includes male-type connector terminals 82. In the coupled state, each of the male-type connector terminals 82 is sandwiched between and in electrical communication with each respective opposing spring-like connector 80. Much like that shown in FIGS. 8*a* and 8*b*, the embodiment of FIGS. 9*a* and 9*b* is also provided with a groove 76 and separator portion 78. FIGS. 1–3 depict the remaining features of the coupling device and the end caps.

Figure 10B:
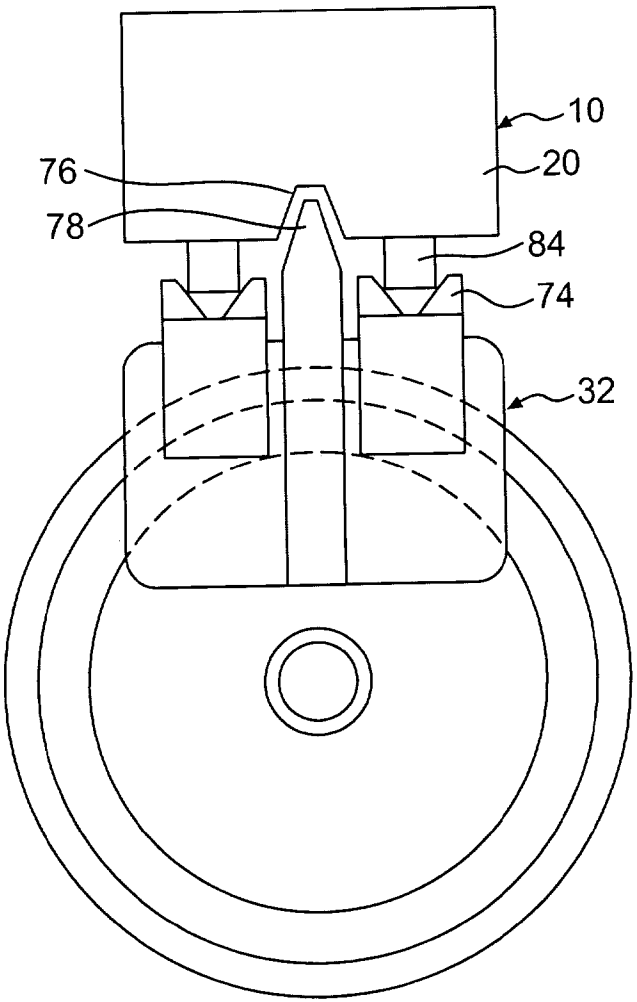
FIGS. 10*a* and 10*b* show an embodiment the coupling device and the end cap of the present invention.
Figure 10A:
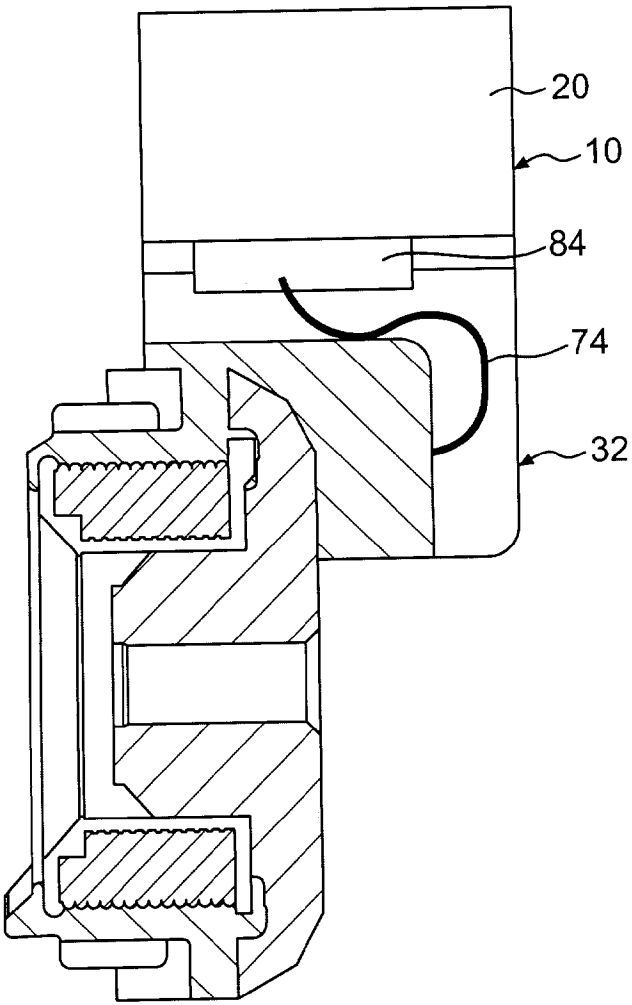

FIGS. 10*a* and 10*b* show another embodiment the coupling device and the end cap of the present invention. In this embodiment, the coupling device housing 20 has plate-like connector terminals 84 and the end cap housing 34 has two sets of opposing spring-like connectors 74. This type of configuration is referred to as a knife-blade connection. In the coupled state, the plate-type connector terminals 84 are in electrical communication with each respective set of opposing spring-like connectors 74. Again, a groove 76 and separator portion 78 is provided in this embodiment. FIGS. 1–3 depict the remaining features of the coupling device and the end caps.

Method of Manufacturing Coupling Device of the Present Invention

Figure 11:
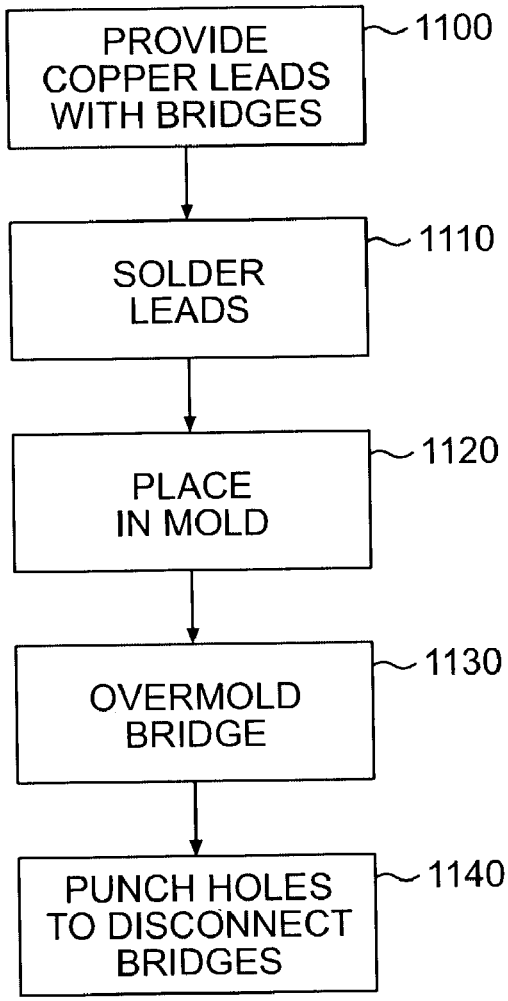
FIG. 11 shows a method of manufacturing the coupling device of the present invention.
Figure 12:
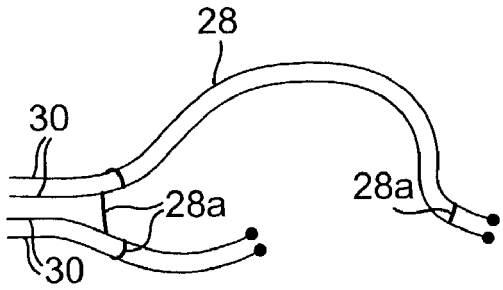
FIG. 12 shows connector leads prior to the molding of the coupling device of the present invention.

FIG. 11 shows a method of manufacturing the coupling device of the present invention. In the method of manufacturing, several copper leads are first provided (step 1100). As seen in FIG. 12, in a preferred embodiment, four copper leads 28 are each connected to adjacent copper leads via a bridging portion 28*a*, which correspond to the placement of the punches or holes 12*a*. The bridging portions 28*a* provide for a robust and stable platform for future molding. Each end of the copper lead is electrically attached (i.e., soldered) to a terminal a respective solenoid wires 30. The assembly shown in FIG. 12 is then placed into a mold (step 1120) which corresponds to a shape of the final product. (Steps 1110 and 1120 may be interchangeable.) In the embodiments, the mold may include the same shape as the coupling device shown in FIG. 1, with housing features, terminals and the like. Accordingly and for discussion purposes, it may be assumed that the coupling device shown in FIG. 1 is substantially identical to the mold used to form the coupling device. The mold includes placement pins, which correspond to the punches or holes 12*a* and the bridge or connector portions 28*a*. The pins are utilized to maintain the conductive leads in a stationary position during the molding process, and are also used to form the holes 12*a* in the coupling device of the present invention. The coupling device 10 is then over-molded in step 1130. Once the mold has set, the coupling device 10 is then taken out of the mold and the holes 12*a* are punched at the bridging portions 28*a* (i.e., at the previous placement of the pins). The punching of the holes eliminates electrical connection between the copper leads 28 thus preventing electrical shorts and the like.

While the invention has been described in terms of preferred embodiments, those skilled in the art will recognize that the invention can be practiced with modification within the spirit and scope of the appended claims.

I claim:

1. A coupling device, comprising:

a body portion adapted to be mated with an end cap assembly of a fuel injector, the body portion having a connecting portion spanning between a first electrical connector and a second electrical connector at opposing ends thereof;

a first set of conductive leads connecting the first electrical connector to a first set of solenoid wires;

a second set of conductive leads connecting the second electrical connector to a second set of solenoid wires, wherein the first set of conductive leads span the connecting portion to connect the first electrical connector and the first set of solenoid wires;

a first housing for housing the first electrical connector; and a second housing for housing the second electrical connector, the first and the second housing extending from the body portion.

2. The coupling device of claim 1, wherein the first housing and the second housing each include a respective cavity for housing the first electrical connector and the second electrical connector.

3. The coupling device of claim 2, wherein the first housing and the second housing are molded to the body portion and are shaped as one of the following shapes: round, square, rectangular and oval.

4. The coupling device of claim 3, further comprising a first locking device and a second locking device adapted to lock to the end caps, the first locking device being placed at a first side of the first housing and the second locking device being placed at a different side of the second housing.

5. The coupling device of claim 1, wherein the first set of conductive leads and the second set of conductive leads are soldered between the first electrical connector and the first set of solenoid wires and the second electrical connector and the second set of solenoid wires, respectively.

6. The coupling device of claim 1, wherein the first electrical connector and the second electrical connector are at least one of (i) female-type electrical connectors, (ii) male-type electrical connectors, (iii) opposing spring-like electrical connectors and (iv) contact plates.

7. The coupling device of claim 1, wherein the first set of conductive leads is molded into the connecting portion.

8. A coupling device for coupling to an end cap of a fuel injector, the coupling device comprising:

a main body portion comprising:

a first shoulder and a second, opposing shoulder, an end body portion adjacent to the second shoulder, a first housing extending from the first shoulder, a second housing extending from the second shoulder, and a connecting portion connecting the first shoulder and the second shoulder;

a first and second set of solenoid wires partially extending within the end body portion;

a first set of terminals associated with the first housing;

a second set of terminals associated with the second housing;

a first set of conductive leads electrically connecting the first set of terminals to the first set of solenoid wires and spanning the connecting portion; and a second set of conductive leads electrically connecting the second set of terminals to the second set of solenoid wires.

9. The coupling device of claim 8, wherein the first and second shoulder, the first and second housing and the connecting portion are a single integral molded piece.

10. The coupling device of claim 8, wherein the first and second set of terminals are at least one of (i) female-type electrical connectors, (ii) male-type electrical connectors, (iii) opposing spring-like electrical connectors and (iv) contact plates.

11. The coupling device of claim 8, wherein the first set of conductive leads is molded into the connecting portion.

12. The coupling device of claim 11, wherein the first and second set of solenoid wires are partially molded into the end body portion.

13. The coupling device of claim 12, wherein the first set of solenoid wires is soldered to the first set of conductive leads and the second set of solenoid wires is soldered to the second set of conductive leads.

14. The coupling device of claim 13, wherein the first and second set of solenoid wires are electrically isolated and the first and second set of conductive leads are electrically isolated.

15. The coupling device of claim 8, further comprising a first locking device associated with the first housing and a second locking device associated with the second housing.

16. A device for coupling a wire harness to a fuel injector, comprising:

a coupling device including:

a body portion having a connecting portion connecting a first housing and a second housing at opposing ends thereof, each of which house first and second terminal portions, respectively, a first set of conductive leads spanning the connecting portion to connect the first terminal portion to a first set of solenoid wires, and a second set of conductive leads connecting the second terminal portion to a second set of solenoid wires; and an end cap assembly coupled to the coupling device, the end cap assembly comprising:

a first housing at a first side for housing a first end cap terminal, and a second housing at a second side for housing a second end cap terminal, wherein the first terminal portion and the first end cap terminal are electrically couplable to one another, and the second terminal portion and the second end cap terminal are electrically couplable to one another.

17. The device of claim 16, wherein: the body portion includes a first shoulder and a second shoulder and an end body portion adjacent to the second shoulder; the first housing extends from the first shoulder and the second housing extends from the second shoulder; and the connecting portion connects the first shoulder and the second shoulder.

18. The device of claim 16, wherein: the first housing of the end cap includes a first cavity; the second housing of the end cap includes a second cavity; and the first and second cavity of the end cap couple within the first and second housing of the coupling device, respectively.

19. The device of claim 16, further comprising a locking device for locking the first housing and the second housing of the coupling device to the first housing and the second housing of the end cap, respectively.

20. The device of claim 16, wherein the first and second set of conductive leads and the first and second set of solenoid wires are molded into the coupling device.

21. The device of claim 16, wherein: the first and second set of terminal portions are at least one of (i) female-type electrical connectors, (ii) male-type electrical connectors, (iii) opposing spring-like electrical connectors and (iv) contact plates; and the first end cap terminal and the second end cap terminal are another of the at least one of (i) female-type electrical connectors, (ii) male-type electrical connectors, (iii) opposing spring-like electrical connectors and (iv) contact plates.

22. The device of claim 16, wherein the connecting portion fits about the end cap assembly.

23. A fuel injector assembly, comprising:

a fuel injector comprising:

a control valve body, an intensifier housing coupled to the control valve body, and a nozzle assembly coupled to the intensifier housing;

a coupling device, including:

a body portion having a connecting portion spanning between a first housing and a second housing, each of which house first and second terminal portions, respectively, a first set of conductive leads spanning the connecting portion to connect the first terminal portion to a first set of solenoid wires, and a second set of conductive leads connecting the second terminal portion to a second set of electrical connector leads; and an end cap assembly coupled to the coupling device and the control valve, the end cap assembly comprising:

a first housing extending from a first side and housing a first end cap terminal portion, and a second housing extending from a second side and housing a second end cap terminal portion, wherein the first terminal portion and the first end cap terminal portion are electrically couplable to one another, and the second terminal portion and the second end cap terminal portion are electrically couplable to one another.

24. The fuel injector assembly of claim 23, wherein the first housing and the second housing of the coupling device are sized to fit within the first housing and the second housing of the end cap, respectively, in order for the first terminal portion and the first end cap terminal portion to be electrically couplable and the second terminal portion and the second end cap terminal portion to be electrically couplable.

25. The fuel injector assembly of claim 23, wherein: the first and second terminal portions are at least one of (i) female-type electrical connectors, (ii) male-type electrical connectors, (iii) opposing spring-like electrical connectors and (iv) contact plates; and the first end cap terminal portion and the second end cap terminal portion are another of the at least one of (i) female-type electrical connectors, (ii) male-type electrical connectors, (iii) opposing spring-like electrical connectors and (iv) contact plates.

26. The fuel injector assembly of claim 23, wherein the connecting portion fits about the control valve.

* * * * *